US005918861A

United States Patent [19]

Parker

[11] Patent Number: 5,918,861

[45] Date of Patent: Jul. 6, 1999

[54] LOAD LIFTING APPARATUS

[76] Inventor: Charles A. Parker, 420 W. Silver St., Marble, Colo. 81623

[21] Appl. No.: 08/892,883

[22] Filed: Jul. 15, 1997

Related U.S. Application Data

[60] Provisional application No. 60/023,917, Aug. 14, 1996.

[51] Int. Cl.[6] ..... B66D 3/00

[52] U.S. Cl. ..... 254/326; 254/327; 212/202

[58] Field of Search ..... 254/47, 48, 325, 254/326, 327, 336, 338; 212/195, 202, 230, 901

[56] References Cited

U.S. PATENT DOCUMENTS

| | | | |
|---|---|---|---|
| 783,672 | 2/1905 | Bock | 254/338 |
| 2,421,437 | 6/1947 | Ryan et al. | 212/195 |
| 2,666,212 | 1/1954 | Flanders | 254/326 |
| 2,804,979 | 9/1957 | Lassiter | 212/202 |
| 2,985,430 | 5/1961 | Greenwood | 254/338 |
| 3,578,290 | 5/1971 | Gof | 254/326 |
| 4,068,827 | 1/1978 | Fanning et al. | 254/325 |
| 4,236,859 | 12/1980 | Stearn et al. . | |
| 4,239,443 | 12/1980 | Rysewyk . | |
| 4,771,988 | 9/1988 | Scroggins | 254/47 |
| 4,782,962 | 11/1988 | Hackworth et al. | 212/195 |
| 5,297,832 | 3/1994 | Dewey et al. . | |
| 5,340,085 | 8/1994 | Keibler . | |
| 5,456,299 | 10/1995 | Kusek et al. . | |
| 5,509,638 | 4/1996 | Leon-Vieito | 254/336 |

FOREIGN PATENT DOCUMENTS

1669849 A1 8/1991 U.S.S.R. .

*Primary Examiner*—John M. Jillions
*Attorney, Agent, or Firm*—Richard C. Litman

[57] ABSTRACT

A load lifting apparatus for enabling an individual user to lift a heavy weight. The load lifting apparatus includes a tricycle type base which supports a vertical beam. The vertical beam is height adjustable. The vertical beam supports a horizontal boom. The horizontal boom is capable of horizontal translational motion relative to the tip of the vertical beam. The horizontal boom has a pulley at each of its ends. A third pulley is supported by the vertical beam. A cable from a powered winch is routed around the pulleys and can have its free end attached to a load. The powered winch is attached to the vertical beam. The tricycle type base has a platform for supporting a counterweight. The powered winch can be operated under the control of the a user to draw in the cable and thus lift a load toward the horizontal boom.

19 Claims, 5 Drawing Sheets

LOAD LIFTING APPARATUS

CROSS-REFERENCE TO RELATED APPLICATION

This application claims the benefit of U.S. Provisional Patent Application Ser. No. 60/023,917, filed Aug. 14, 1996.

BACKGROUND OF THE INVENTION

1. Field of the Invention

The present invention relates to a mobile hoist for enabling a user to lift relatively heavy loads. More particularly, the present invention is directed to a movable hoist having a base provided with casters, a vertical beam supported by the base, and a horizontal boom having a pulley and cable system supported by the vertical beam.

2. Description of the Related Art

In the construction industry, it is often necessary for workers to manipulate heavy and/or large sized objects such as drywall panels, girder beams, wood beams, logs, etc. It may be necessary for workers to move and/or lift such objects, for example, when installing the object in place or when moving the object to a higher story. Large cranes, used in large scale construction projects, could be used to perform such tasks. However, such large cranes are prohibitively expensive for small scale construction projects, and could not be used when a roof or other building structure covers the location at which the manipulation of the heavy and/or oversized object is to take place.

Therefore, the present invention which allows workers to easily manipulate heavy and/or oversize objects, would be very useful in the construction industry. In addition, the load lifting apparatus of the present invention will be generally useful for manipulating heavy and/or oversize objects and thus will have a myriad of different applications. For example, the load lifting apparatus of the present invention would be useful in stacking objects in a warehouse type environment. Although mobile hoists are known in the related art none are seen to have the unique structure, the ease of fabrication, and the simplicity of the present invention.

U.S. Pat. No. 4,236,859, issued to Richard A. Stearn et al. on Dec. 2, 1980, shows a mobile hoist with a frame that straddles the object to be lifted. Pairs of straps cradle the object to be lifted. Each pair of straps is supported by a pulley system on either side of the frame structure. The pulley systems are used to lift the ends of the straps, thus lifting the object cradled by the straps. Stearn et al. does not show the tricycle type base or the translatable horizontal boom of the present invention.

U.S. Pat. No. 4,239,443, issued to Ambrose L. Rysewyk on Dec. 16, 1980, shows a mobile hoist for loading and unloading articles onto and from shelves. The Rysewyk device has a fixed length vertical beam. The horizontal boom rides up and down in tracks provided in the vertical beam. Rysewyk does not show the tricycle type base, the height adjustable vertical beam, or the translatable horizontal boom with a pulley at each end as used in the present invention.

U.S. Pat. No. 5,297,832, issued to Fred Dewey et al. on Mar. 29, 1994, shows an apparatus for lifting bundles of logs from the bed of a truck. Dewey et al. does not show the tricycle type base, the height adjustable vertical beam, or the translatable horizontal boom with a pulley at each end as used in the present invention.

U.S. Pat. No. 5,340,085, issued to Howard M. Keibler on Aug. 23, 1994, shows an apparatus for allowing one person to lift heavy logs. Keibler does not show the tricycle type base, the height adjustable vertical beam, or the translatable horizontal boom with a pulley at each end as used in the present invention.

U.S. Pat. No. 5,456,299, issued to Denis Kusek et al. on Oct. 10, 1995, shows a mobile log cutting apparatus. Kusek et al. does not show the tricycle type base, the height adjustable vertical beam, or the translatable horizontal boom with a pulley at each end as used in the present invention.

Soviet inventor's certificate 1669849, dated Aug. 15, 1991, shows an apparatus for lifting slabs. Soviet document '849 does not show the tricycle type base, the height adjustable vertical beam, or the translatable horizontal boom with a pulley at each end as used in the present invention.

None of the above inventions and patents, taken either singly or in combination, is seen to describe the instant invention as claimed.

SUMMARY OF THE INVENTION

The present invention is directed to a load lifting apparatus for enabling an individual user to lift a heavy weight. The load lifting apparatus includes a tricycle type base which supports a vertical beam. The vertical beam is height adjustable. The vertical beam supports a horizontal boom. The horizontal boom is capable of horizontal translational motion relative to the tip of the vertical beam. The horizontal boom has a pulley at each of its ends. A third pulley is supported by the vertical beam. A cable from a powered winch is routed around the pulleys and can have its free end attached to a load. The powered winch is attached to the vertical beam. The tricycle type base has a platform for supporting a counterweight. The powered winch can be operated under the control of the a user to draw in the cable and thus lift a load toward the horizontal boom.

Accordingly, it is a principal object of the invention to provide an apparatus for allowing one man to manipulate heavy and/or oversize objects.

It is another object of the invention to provide an apparatus for moving heavy and/or oversize objects, with the apparatus having a mobile base that can selectively be immobilized.

It is a further object of the invention to provide an apparatus for moving heavy and/or oversize objects, with the apparatus having a height adjustable vertical beam.

Still another object of the invention is to provide an apparatus for moving heavy and/or oversize objects, with the apparatus having a horizontal boom that is horizontally translatable relative to the apparatus base.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
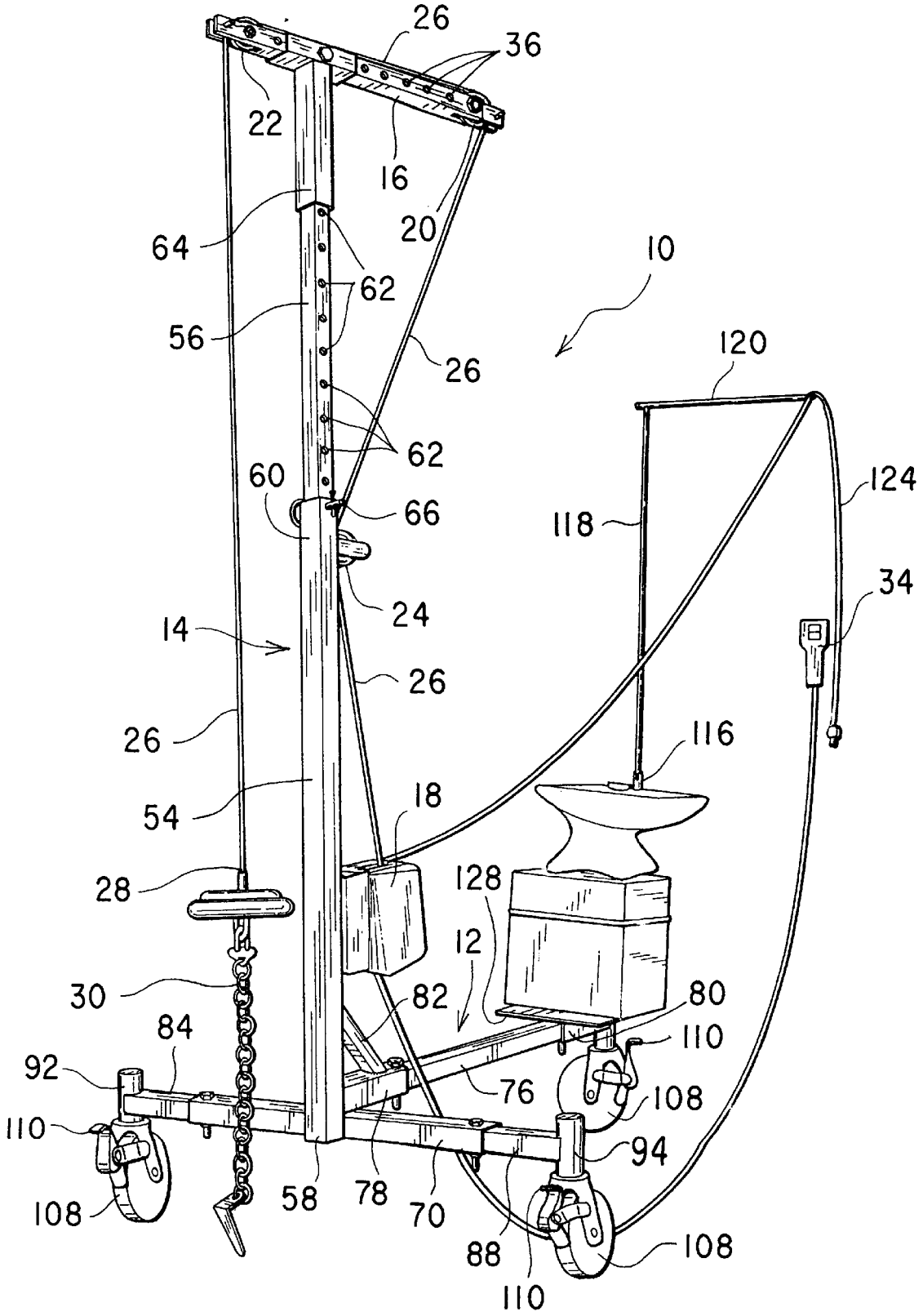
FIG. 1 is a perspective view of a load lifting apparatus according to the present invention.

Referring to FIGS. 1 through 5, the present invention is a load lifting apparatus 10 for lifting and moving heavy and/or oversized objects. The load lifting apparatus 10 includes a mobile carriage or base 12, a vertical beam 14, a horizontal boom 16, and a powered winch 18. The vertical beam 14 is supported by the mobile carriage 12, and the vertical beam 14 is adjustable in height. The horizontal boom 16 is supported at the tip of the vertical beam 14. The horizontal boom 16 is capable of translational movement along the direction of its longitudinal axis relative to the tip of the vertical beam 14. The height of the horizontal boom 16 above the base 12 can be varied as desired by changing the height of the vertical beam 14.

A first pulley 20 is rotatably supported near a first end of the horizontal boom 16. A second pulley 22 is rotatably supported near a second end of the horizontal boom 16. A third pulley 24 is rotatably supported by the vertical beam 14. A length of cable 26 is wound around the spool of the winch 18. The remainder of the cable 26 is routed between the pulley 24 and the vertical beam 14, around the pulley 20, over the horizontal boom 16, and around the pulley 22. The cable 26 terminates at a free end 28. Attachment means, such as a chain 30 or a hook 32 (see FIG. 4), is provided at the free end 28 of the cable 26 for attaching the cable 26 to a load to be lifted and/or moved.

The powered winch 18, mounted to the vertical beam 14, is preferably electrically powered although it can also be powered by a small gasoline engine. An electrically powered winch is preferred because an electric winch can be plugged in to electrical power supplies that are readily available at construction sites. The powered winch 18 is controlled by the remote control panel or switch 34 which allows a user to operate the winch in the forward direction, in the reverse direction, or to stop the winch completely. Thus the winch 18 can be used to selectively pay out, retract, or stop the cable 26 under the control of a user. With the free end 28 of the cable 26 attached to a load, the load lifting apparatus 10 can be used to lift or lower the load by operating the winch 18 in the reverse or forward directions respectively.

Figure 3:
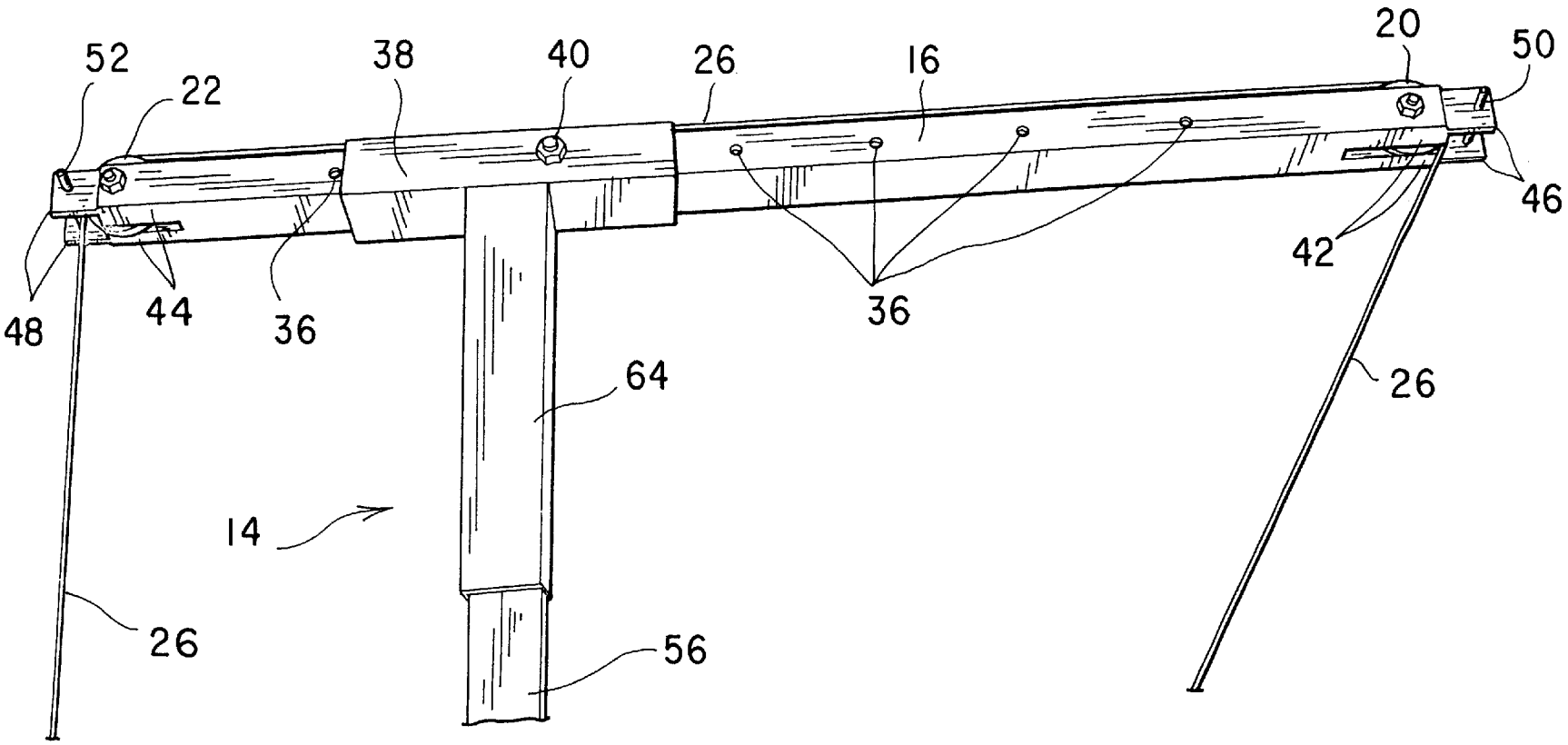
FIG. 3 is a fragmentary view showing details of the horizontal boom of the load lifting apparatus of the present invention.
Figure 4:
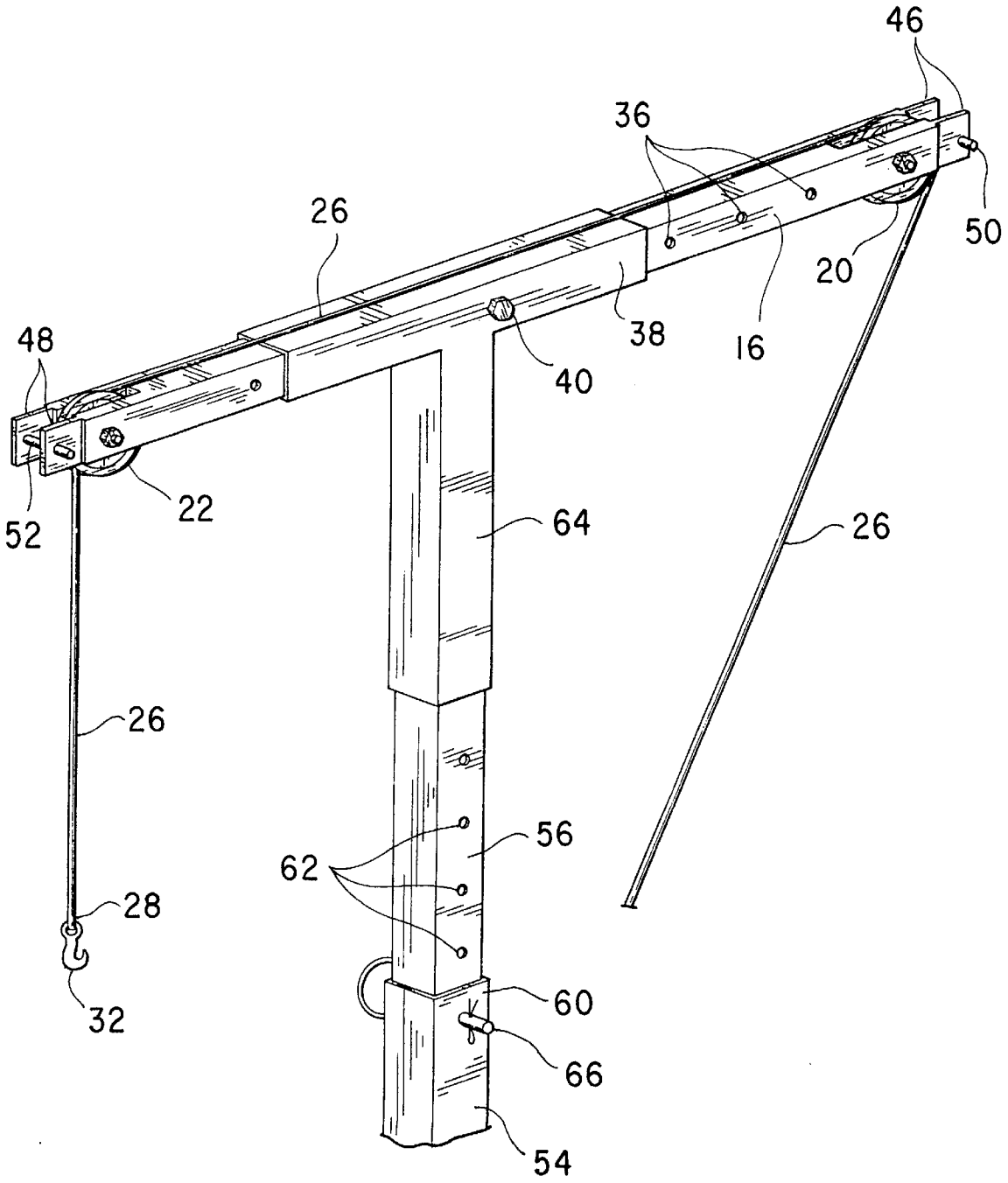
FIG. 4 is a fragmentary view showing details of the height adjustment mechanism of the vertical beam of the load lifting apparatus of the present invention.

Referring to FIGS. 1, 3, and 4, the details of the mounting of the horizontal boom 16 to the vertical beam 14 can be seen. The horizontal boom 16 has a first plurality of holes 36 distributed along the length thereof. A first horizontal sleeve 38 is fixed to the tip of the vertical beam 14. The first horizontal sleeve 38 has a first through-hole for receiving a bolt 40. A portion of the horizontal boom 16 is supported within the first horizontal sleeve 38, and the horizontal boom 16 can slidably move relative to the first horizontal sleeve 38. The first bolt 40 passes through the first through-hole and engages a selected one of the holes 36 to thereby fix the horizontal boom 16 at a desired position relative to the tip of the vertical beam 14. The bolt 40 can be secured in place by a nut (not shown) on the side of the sleeve 38 opposite the side through which the bolt 40 is initially inserted. The adjustability of the horizontal position of the horizontal boom 16 allows the amount to which the horizontal boom 16 overhangs the front of the base 12 (the front being the end of the base 12 having two casters), to be set to match the requirements of a particular job site.

The ends of the horizontal boom 16 are bifurcated with the pulleys 20 and 22 fitting between the prongs 42 and 44, respectively, of the bifurcations. A shaft passes between each pair of prongs 42 and 44 to rotatably support the pulleys 20 and 22. At times when some slack exists in the cable 26, for example when attaching or disconnecting the cable 26 from a load, the cable can come out of alignment with the pulleys 20 and 22. When tension is again applied to the cable 26, the cable 26 may then come completely off of one or both of the pulleys 20 and 22. To avert such a mishap, the prongs 42 and 44 are provided with extensions 46 and 48 respectively. Each pair of extensions 46 and 48 has a pin, 50 and 52 respectively, passing through and extending between the pair of extensions, 46 and 48. The pins 50 and 52 maintain the cable 26 in the proper position such that when tension is reapplied to the cable 26, the cable 26 will naturally tend to return to its position around the pulleys 20 and 22. The peripheral surfaces of the pulleys 20, 22, and 24 which contact the cable 26, are preferably concave to facilitate maintaining of the cable 26 in contact with the pulleys.

The vertical beam 14 includes a vertical sleeve member 54 and a telescoping member 56. The vertical sleeve member 54 has a first end 58, a second end 60, a second through hole, and a hollow interior. The second end 60 of the vertical sleeve member 54 is open so as to receive the telescoping member 56. The telescoping member 56 has a first end (not shown), a second end (not shown), and a second plurality of holes 62 distributed along its length.

At least a portion of the telescoping member 56, including its first end, is inserted into the hollow interior of the vertical sleeve member 54 through the second end 60 of the vertical sleeve member 54. The telescoping member 56 is slidably movable within the hollow interior of the vertical sleeve member 54 such that the telescoping member 56 penetrates into the hollow interior of the vertical sleeve member 54 to a variable amount. The first end 58 of the vertical sleeve member 54 is attached to the mobile carriage 12. The first horizontal sleeve 38 is fixed to a vertical beam tip sleeve 64 in a "T" configuration. The vertical beam tip sleeve 64 is in turn mounted to the second end or tip of the telescoping member 56. With this arrangement, it should readily be apparent that the height of the horizontal boom 16 will vary in response to movement of the telescoping member 56.

A pin 66 passing through the second through-hole and a selected one of the holes 62, is used to fix the amount of penetration of the telescoping member 56 into the vertical sleeve member 54 at a user selected value, and thus fix the height of the vertical beam 14 at a user selected height.

Figure 2:
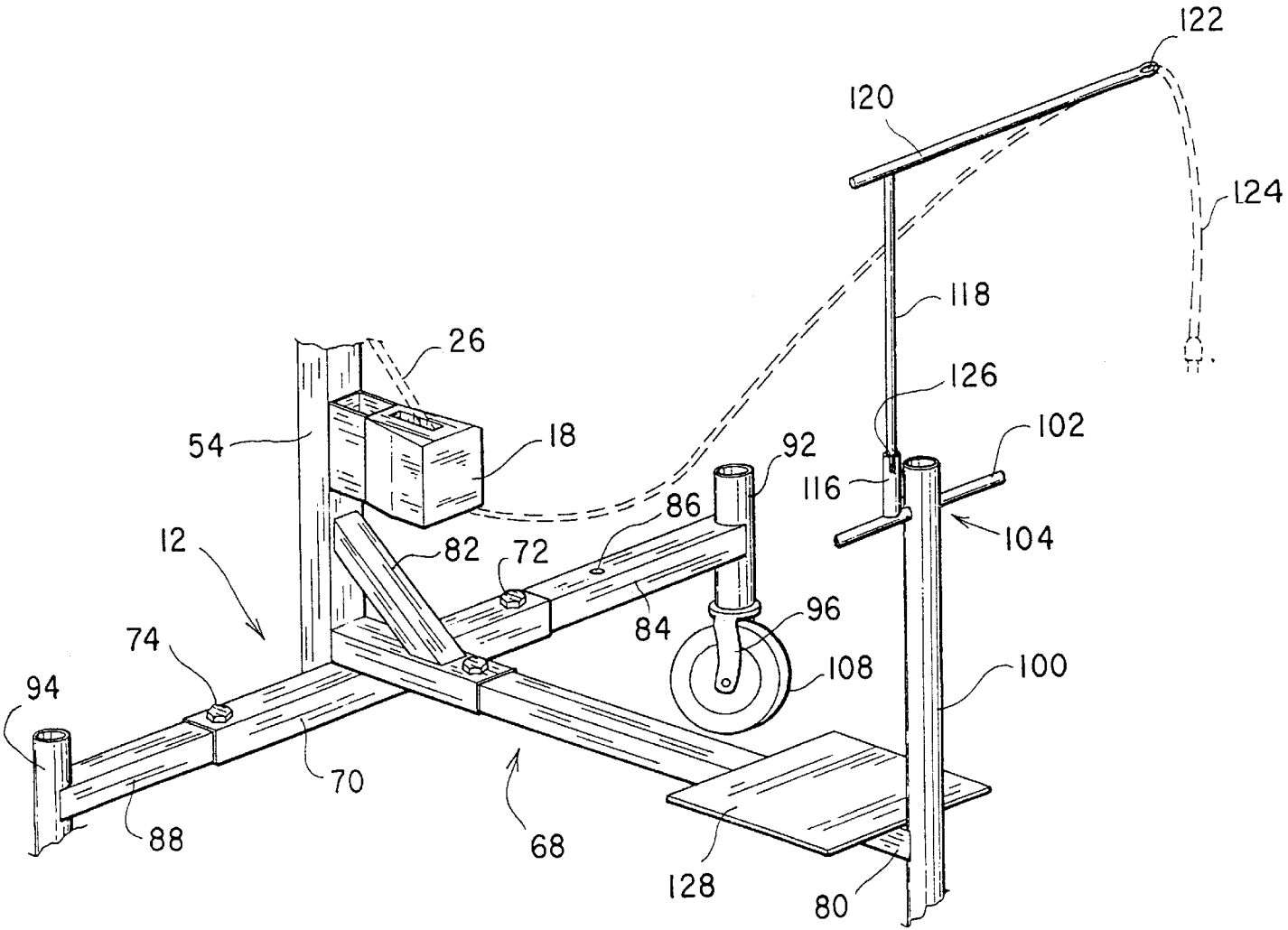
FIG. 2 is a fragmentary view showing details of the tricycle type base or carriage of the load lifting apparatus of the present invention.
Figure 5:
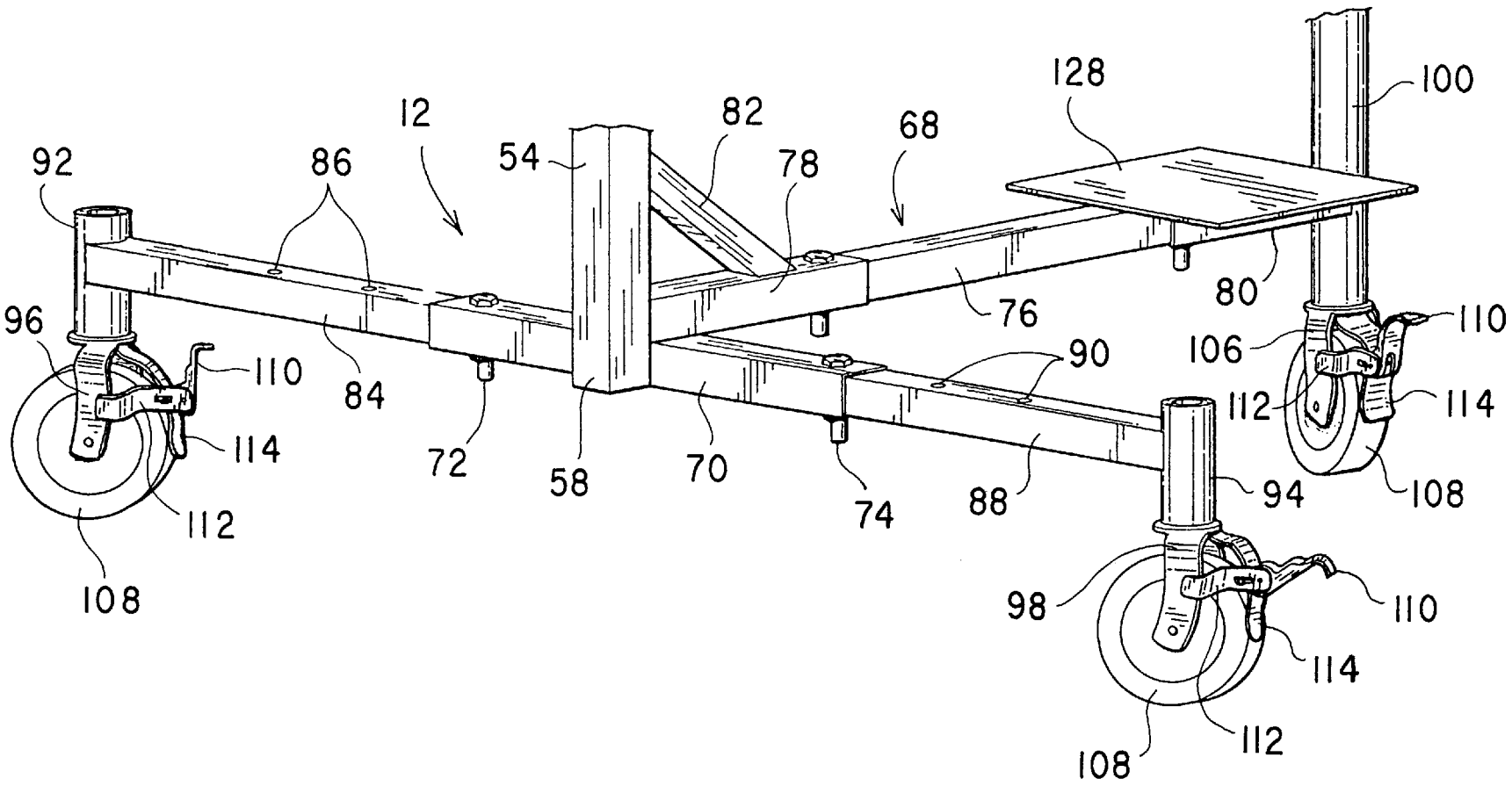
FIG. 5 is a fragmentary view showing details of the casters of the tricycle type base or carriage of the load lifting apparatus of the present invention.

Referring to FIGS. 1, 2, and 5, the mobile carriage or base 12 is generally in the shape of a "T" with a longitudinal member 68 and a transverse sleeve member 70. The transverse sleeve member 70 is open at both ends and has a hollow interior. The transverse sleeve member 70 also has third and fourth through-holes at either of its ends to allow bolts 72 and 74 to pass therethrough.

The longitudinal member 68 includes a horizontal beam 76 and two end sleeves 78 and 80. The end sleeve 78 is welded at a right angle to the transverse sleeve member 70 to form a "T" shape. The first end 58 of the vertical sleeve member 54 is welded to and abuts both the transverse sleeve member 70 and the end sleeve 78. A reinforcing brace 82 extends between the vertical sleeve member 54 and the end sleeve 78. Each end of the horizontal beam 76 is inserted into a respective one of the end sleeves 78 and 80. The ends of the horizontal beam 76 are then fixed to the end sleeves 78 and 80 by bolts.

A first lateral arm 84 is partially inserted into one end of the transverse sleeve 70. The first lateral arm 84 is slidably movable within the transverse sleeve 70, and has a third plurality of holes 86 distributed along its length. Similarly, a second lateral arm 88 is partially inserted into the other end of the transverse sleeve 70. The second lateral arm 88 is slidably movable within the transverse sleeve 70, and has a fourth plurality of holes 90 distributed along its length. The bolts 72 and 74 are used to fix the distance to which the lateral arms 84 and 88, project from the ends of the transverse sleeve 70, by engaging a user selected one of the plurality of holes 86 and 90 respectively.

Vertical tubes 92 and 94 are fixed to the ends of the lateral arms 84 and 88 lying outside the transverse sleeve 70, respectively. Forks 96 and 98 extend from the vertical tubes 92 and 94, and can revolve freely about the longitudinal axes of the vertical tubes 92 and 94. A tube 100 is fixed to the end of the sleeve 80 which is distal from the vertical beam 14. The tube 100 extends from the floor to roughly the height of the human midsection, and in cooperation with the crossbar 102 forms the T-shaped handle 104. A fork 106 extends from the vertical tube 100, and can revolve freely about the longitudinal axis of the vertical tube 100.

The forks 96, 98, and 106 rotatably support wheels or casters 108. The wheels or casters 108 are lockable, meaning that they can be prevented from rotating at the option of the user. The casters 108 are individually locked using the levers 110. The forks 96, 98, and 106 have brackets 112 which pivotally support the levers 110. Each lever 110 has a cam portion formed by the end of the levers 110 which is distal from the end of the levers 110 engaged by the user. The cam portion of each lever 110 projects beyond the pivot point of the lever. When the levers 110 are pivoted downward, the cam portion of each lever 110 is wedged between the pivot point of the lever and the respective spring steel braking strip 114 (see FIG. 5). The action of the cam portion of the levers 110 causes the braking strips 114 to frictionally engage the casters 108, thus braking or locking the casters. This feature allows for greater safety and ease of operation, because it keeps the load lifting apparatus 10 from rolling or moving inadvertently when a load is being raised or lowered.

Fixed to the crossbar 102 is a hollow tube 116 (see FIG. 2). The tube 116 receives the end of an elongated rod 118. A second rod 120 is welded at a right angle to the upper tip of the rod 118. The end of the rod 120 distal from the rod 118, is provided with a hoop 122. The power cord 124 which supplies electricity to the winch 18, is threaded through the hoop 122 and thus kept from interfering with the operation of the load lifting apparatus 10. This arrangement prevents the power cord 124 from getting entangled around the casters 108 as the load lifting apparatus 10 is pushed, with the casters rolling freely, from one location to another. The tube 116 has at least one slot 126 (and preferably four) which slidably receives a projection fixed to the rod 118. Thus, the rod 118 is prevented from rotating about it longitudinal axis and uncontrollably swinging the rod 120, especially as the load lifting apparatus 10 is being moved around at the job site.

Attached to the top of sleeve 80 is a platform 128. The platform 128 is intended to support a counterweight to counteract the moment generated by a load applied to the free end of the cable 26, and thus prevent the load lifting apparatus 10 from tipping over. In the illustrated example the counterweight includes a block of marble and an anvil.

To illustrate the use of the load lifting apparatus 10, consider a situation where a load of logs is to be lifted to the second story of a building under construction. The load lifting apparatus 10 is on the second floor and is positioned adjacent an outer wall of the building such that the end of the horizontal boom 16 supporting pulley 22, overhangs the outer wall of the building. The casters 108 are locked and the winch 18 is operated in the forward direction to pay out sufficient cable 26 to reach the load at ground level. Once the free end of the cable 26 is secured to the load the winch is operated in the reverse direction to retract the cable 26 and lift the load. Under these conditions, the counterweight prevents the load lifting apparatus from tipping over. Once the load reaches the second story and is high enough to clear any barrier, the winch is stopped. Now the casters 108 are unlocked and the apparatus is rolled to move the load to the location where the load is to be deposited. Finally, the casters are again locked and the load lowered to the desired location using the winch 18.

It is to be understood that the present invention is not limited to the sole embodiment described above, but encompasses any and all embodiments within the scope of the following claims.

I claim:

1. A load lifting apparatus comprising:

a mobile carriage, wherein said mobile carriage includes:

a vertical beam supported by said mobile carriage, said vertical beam having a tip, said vertical beam having an adjustable length;

a transverse sleeve member having a first end portion, a middle portion and a second end portion said vertical beam being attached to said middle portion of said transverse sleeve member; and a longitudinal member having a first end portion and a second end portion, said first end portion being attached to said middle portion of said transverse sleeve member;

a horizontal boom adjustably supported by said tip of said vertical beam, said horizontal boom having a longitudinal axis, a first end, and a second end, said horizontal boom being translatable along said longitudinal axis;

a first pulley rotatably supported by said first end of said horizontal boom;

a second pulley rotatably supported by said second end of said horizontal boom;

a winch mounted to said vertical beam; and a cable having a first end and a second end, said first end being attached to a load, said second end being attached to said winch, said cable being routed around said first pulley and said second pulley.

2. The load lifting apparatus according to claim 1 further comprising means for attaching said first end of said cable to a load.

3. The load lifting apparatus according to claim 1 wherein said winch is electrically powered.

4. The load lifting apparatus according to claim 1 wherein said winch includes means for remotely controlling said winch.

5. The load lifting apparatus according to claim 1 wherein:

said horizontal boom has a first plurality of holes distributed along said horizontal axis;

said tip of said vertical beam has a first horizontal sleeve fixed thereto, said first horizontal sleeve having a first through-hole, said horizontal boom being slidably supported within said first horizontal sleeve; and said load lifting apparatus further includes a first bolt passing through said first through-hole of said first horizontal sleeve and a selected one of said first plurality of holes of said horizontal boom.

6. The load lifting apparatus according to claim 1 wherein said vertical beam includes:

a vertical sleeve member having a first end, a second end, and a second through-hole, said first end of said vertical sleeve member being attached to said mobile carriage and said second end of said vertical sleeve member being said tip, and a telescoping member having a first end, a second end, a length, and a second plurality of holes distributed along said length thereof, said first end of said telescoping member being slidably received within said second end of said vertical sleeve, said horizontal boom being supported by said second end of said telescoping member; and said load lifting apparatus further includes a pin passing through said second through-hole of said vertical sleeve and a selected one of said second plurality of holes of said telescoping member.

7. The load lifting apparatus according to claim 1 wherein said load lifting apparatus further comprises a brace extending between said longitudinal member and said vertical beam.

8. The load lifting apparatus according to claim 1 wherein said mobile carriage further includes a platform supported by said second end portion of said longitudinal member, said platform being dimensioned and configured to support a counterweight.

9. The load lifting apparatus according to claim 1 wherein said mobile carriage further includes a T-shaped handle linked to said second end portion of said longitudinal member.

10. The load lifting apparatus according to claim 9 wherein said mobile carriage further includes:

an elongated member having a first end and a second end, said first end of said elongated member being supported by said T-shaped handle; and a loop attached to said second end of said elongated member, said loop being dimensioned and configured to receive a cord.

11. The load lifting apparatus according to claim 10 wherein said first end of said elongated member is detachably mounted on said T-shaped handle.

12. The load lifting apparatus according to claim 1 wherein said mobile carriage further includes:

said transverse sleeve member having a third through-hole on said first end portion and a fourth through-hole on said second end portion;

a first lateral arm having a first end, a second end, a length, and a third plurality of holes distributed along said length thereof, said first end of said first lateral arm being slidably received within said first end portion of said transverse sleeve member;

a second lateral arm having a first end, a second end, a length, and a fourth plurality of holes distributed along said length thereof, said first end of said second lateral arm being slidably received within said second end portion of said transverse sleeve member;

a second bolt passing through said third through-hole and a selected one of said third plurality of holes; and a third bolt passing through said fourth through-hole and a selected one of said fourth plurality of holes.

13. The load lifting apparatus according to claim 12 wherein said mobile carriage further includes:

a first lockable caster linked to said second end of said first lateral arm;

a second lockable caster linked to said second end of said second lateral arm;

a third lockable caster linked to said second end portion of said longitudinal member.

14. The load lifting apparatus according to claim 1 further comprising a third pulley rotatably supported by said vertical beam, said cable being routed around said third pulley.

15. A load lifting apparatus for lifting heavy objects, said load lifting apparatus comprising:

a mobile carriage, wherein said mobile carriage includes:

a longitudinal member having a first end and a second end; and a transverse sleeve member having a first open end, a second open end, a hollow interior, a third through hole in proximity to said first open end of said transverse sleeve member, and a fourth through hole in proximity to said second open end of said transverse sleeve member;

said first end of said longitudinal member being attached to the middle portion of said transverse sleeve member;

a vertical beam supported by said mobile carriage at the middle portion of said transverse sleeve member, said vertical beam having a height and said height of said vertical beam being adjustable, and said vertical beam having a tip;

a horizontal boom supported proximate said tip of said vertical beam, said horizontal boom having a longitudinal axis, a first end and a second end, said horizontal boom being translatable relative to said vertical beam in a direction coincident with said longitudinal axis of said horizontal boom, and said horizontal boom being translatable vertically responsive to said height of said vertical beam;

a first pulley rotatably supported proximate said first end of said horizontal boom;

a second pulley rotatably supported proximate said second end of said horizontal boom;

a cable having a free end;

a powered winch mounted along said vertical beam, said powered winch storing at least a portion of said cable, said powered winch selectably paying out and retracting said cable under the control of a user; and attachment means provided at said free end of said cable for attaching said free end of said cable to a load, whereby when said cable is routed around said first and second pulleys and said free end of said cable is attached to a load, said load lifting apparatus can be used to lift the load.

16. The load lifting apparatus according to claim 15, wherein said horizontal boom has a length and a first plurality of holes distributed along said length thereof, said load lifting apparatus further including:

a first horizontal sleeve fixed to said tip of said vertical beam, said first horizontal sleeve having a first through hole therein, a portion of said horizontal boom being slidably supported within said first horizontal sleeve such that said horizontal boom can slidably move relative to said first horizontal sleeve; and a first bolt passing through said first through hole and a selected one of said first plurality of holes to thereby fix said horizontal boom at a user selected position relative to said tip of said vertical beam.

17. The load lifting apparatus according to claim 16, wherein said vertical beam includes a vertical sleeve member and a telescoping member, said vertical sleeve member having a first end, a second end, a second through hole, and a hollow interior, said second end of said vertical sleeve member being open, said telescoping member having a first end, a second end, a length, and a second plurality of holes distributed along said length thereof, at least a portion of said telescoping member including said first end thereof being inserted into said hollow interior of said vertical sleeve member through said second end of said vertical sleeve member, said telescoping member being slidably movable within said hollow interior of said vertical sleeve member so as to penetrate into said hollow interior of said vertical sleeve member to a variable amount, said first end of said vertical sleeve member being attached to said mobile carriage, and said first horizontal sleeve being fixedly supported proximate said second end of said telescoping member so as to move responsive to movement of said telescoping member, said load lifting apparatus further including:

a pin passing through said second through hole and a selected one of said second plurality of holes to thereby fix said variable amount of penetration of said telescoping member into said vertical sleeve member at a user selected value, and thus fix said height of said vertical beam at a user selected height.

18. The load lifting apparatus according to claim 17, wherein said mobile carriage includes:

said second end of said longitudinal member being attached to said transverse sleeve member at about midway between said first open end of said transverse sleeve member and said second open end of said transverse sleeve member, and said longitudinal member being at about a right angle to said transverse sleeve member, said first end of said vertical sleeve member being attached to said mobile carriage proximate a point midway between said first open end of said transverse sleeve member and said second open end of said transverse sleeve member;

a first lateral arm having a first end, a second end, a length, and a third plurality of holes distributed along said length thereof, at least a portion of said first lateral arm including said first end thereof being inserted into said hollow interior of said transverse sleeve member through said first open end of said transverse sleeve member, said first lateral arm being slidably movable within said hollow interior of said transverse sleeve member such that said portion of said first lateral arm inserted into said hollow interior of said transverse sleeve member is variable in length;

a second lateral arm having a first end, a second end, a length, and a fourth plurality of holes distributed along said length thereof, at least a portion of said second lateral arm including said first end thereof being inserted into said hollow interior of said transverse sleeve member through said second open end of said transverse sleeve member, said second lateral arm being slidably movable within said hollow interior of said transverse sleeve member such that said portion of said second lateral arm inserted into said hollow interior of said transverse sleeve member is variable in length;

a second bolt passing through said third through hole and a selected one of said third plurality of holes to thereby fix an amount of projection of said first lateral arm from said first open end of said transverse sleeve member at a user selected amount;

a third bolt passing through said fourth through hole and a selected one of said fourth plurality of holes to thereby fix an amount of projection of said second lateral arm from said second open end of said transverse sleeve member at a second user selected amount;

a first lockable caster linked to said second end of said first lateral arm;

a second lockable caster linked to said second end of said second lateral arm; and a third lockable caster linked to said first end of said longitudinal member, whereby said first, second, and third lockable casters selectably imparting mobility to said mobile carriage.

19. The load lifting apparatus according to claim 18, wherein said mobile carriage further includes:

a platform supported by said longitudinal member proximate to said first end of said longitudinal member, said platform being dimensioned and configured to support a counterweight; and a T-shaped handle linked to said first end of said longitudinal member.

* * * * *